US007811206B2

(12) United States Patent
Chuang et al.

(10) Patent No.: US 7,811,206 B2
(45) Date of Patent: Oct. 12, 2010

(54) ELLIPTICAL EXERCISE DEVICE

(76) Inventors: Jin Chen Chuang, No. 17, Lane 301, Nanyang Road, Fong Yuan, Taichung Hsien 42083 (TW); Lung Fei Chuang, No. 17, Lane 301, Nanyang Road, Fong Yuan, Taichung Hsien 42083 (TW)

( * ) Notice: Subject to any disclaimer, the term of this patent is extended or adjusted under 35 U.S.C. 154(b) by 0 days.

(21) Appl. No.: 11/825,350

(22) Filed: Jul. 6, 2007

(65) Prior Publication Data

US 2009/0011904 A1 Jan. 8, 2009

(51) Int. Cl.
*A63B 22/04* (2006.01)

(52) U.S. Cl. ..... 482/52; 482/57

(58) Field of Classification Search ..... 482/51–53, 482/70, 74, 57, 63
See application file for complete search history.

(56) References Cited

U.S. PATENT DOCUMENTS 5,290,211 A * 3/1994 Stearns ..... 482/53
5,336,141 A * 8/1994 Vittone ..... 482/51
5,419,751 A * 5/1995 Byrd et al. ..... 482/138
5,499,956 A * 3/1996 Habing et al. ..... 482/52
5,529,555 A * 6/1996 Rodgers, Jr. ..... 482/57
5,540,637 A * 7/1996 Rodgers, Jr. ..... 482/52
5,577,985 A * 11/1996 Miller ..... 482/52
5,595,553 A * 1/1997 Rodgers, Jr. ..... 482/51
5,611,756 A * 3/1997 Miller ..... 482/52
5,683,333 A * 11/1997 Rodgers, Jr. ..... 482/57
5,769,760 A * 6/1998 Lin et al. ..... 482/52
5,857,940 A * 1/1999 Husted ..... 482/51
5,911,649 A * 6/1999 Miller ..... 482/52
5,924,962 A * 7/1999 Rodgers, Jr. ..... 482/57
5,957,814 A * 9/1999 Eschenbach ..... 482/51
6,022,296 A * 2/2000 Yu ..... 482/52
6,024,676 A * 2/2000 Eschenbach ..... 482/51
6,027,430 A * 2/2000 Stearns et al. ..... 482/51
6,030,319 A * 2/2000 Wu ..... 482/51
6,045,487 A * 4/2000 Miller ..... 482/52
6,053,847 A * 4/2000 Stearns et al. ..... 482/51
6,077,198 A * 6/2000 Eschenbach ..... 482/52
6,090,013 A * 7/2000 Eschenbach ..... 482/52
6,099,439 A * 8/2000 Ryan et al. ..... 482/51
6,168,552 B1 * 1/2001 Eschenbach ..... 482/52
6,248,044 B1 * 6/2001 Stearns et al. ..... 482/52
6,254,514 B1 * 7/2001 Maresh et al. ..... 482/52
6,422,976 B1 * 7/2002 Eschenbach ..... 482/52
6,422,977 B1 * 7/2002 Eschenbach ..... 482/52
6,440,042 B2 * 8/2002 Eschenbach ..... 482/52
6,612,969 B2 * 9/2003 Eschenbach ..... 482/51
6,648,800 B2 * 11/2003 Stearns et al. ..... 482/52

(Continued)

*Primary Examiner*—Loan H Thanh
*Assistant Examiner*—Daniel F Roland
(74) *Attorney, Agent, or Firm*—Charles E. Baxley

(57) ABSTRACT

An exercise device includes two cranks rotatably coupled to an upright support of a base, two handles pivotally coupled to the upright support, and two foot supports each having a front portion pivotally coupled to the pivot rod or an extended arm of the cranks with a link and each having a rear portion pivotally coupled to the rear portion of the base, and the lower portions of the handles are pivotally coupled to the foot supports to allow the moving stroke of the foot supports to be controlled by the handles. The handles may be pivotally coupled to the cranks with levers. A foot pedal may be pivotally supported on each of the foot supports and pivotally coupled to the handles.

8 Claims, 6 Drawing Sheets

U.S. PATENT DOCUMENTS

| | | | | |
|---|---|---|---|---|
| 6,672,994 | B1 * | 1/2004 | Stearns et al. | 482/57 |
| 6,758,790 | B1 * | 7/2004 | Ellis | 482/52 |
| 6,994,657 | B1 * | 2/2006 | Eschenbach | 482/52 |
| 7,037,242 | B2 * | 5/2006 | Lo et al. | 482/52 |
| 7,104,929 | B1 * | 9/2006 | Eschenbach | 482/52 |
| 7,175,568 | B2 * | 2/2007 | Eschenbach | 482/52 |
| 7,201,705 | B2 * | 4/2007 | Rodgers, Jr. | 482/52 |
| 7,214,168 | B2 * | 5/2007 | Rodgers, Jr. | 482/52 |
| 7,270,626 | B2 * | 9/2007 | Porth | 482/52 |
| 7,300,387 | B2 * | 11/2007 | Wang | 482/52 |
| 7,377,881 | B2 * | 5/2008 | Moon | 482/52 |
| 7,485,072 | B2 * | 2/2009 | Chuang et al. | 482/52 |
| 2001/0016541 | A1 * | 8/2001 | Maresh et al. | 482/52 |
| 2001/0036886 | A1 * | 11/2001 | Eschenbach | 482/142 |
| 2001/0044363 | A1 * | 11/2001 | Lo | 482/52 |
| 2002/0019298 | A1 * | 2/2002 | Eschenbach | 482/51 |
| 2003/0022763 | A1 * | 1/2003 | Ryan et al. | 482/51 |
| 2004/0248704 | A1 * | 12/2004 | Rodgers, Jr. | 482/83 |
| 2004/0248705 | A1 * | 12/2004 | Rodgers, Jr. | 482/83 |
| 2004/0248706 | A1 * | 12/2004 | Rodgers, Jr. | 482/83 |
| 2004/0248707 | A1 * | 12/2004 | Rodgers, Jr. | 482/83 |
| 2004/0248708 | A1 * | 12/2004 | Rodgers, Jr. | 482/83 |
| 2004/0248709 | A1 * | 12/2004 | Rodgers, Jr. | 482/83 |
| 2004/0248710 | A1 * | 12/2004 | Rodgers, Jr. | 482/86 |
| 2004/0248711 | A1 * | 12/2004 | Rodgers, Jr. | 482/86 |
| 2005/0049117 | A1 * | 3/2005 | Rodgers, Jr. | 482/52 |
| 2005/0148438 | A1 * | 7/2005 | Carlsen et al. | 482/52 |
| 2005/0164835 | A1 * | 7/2005 | Porth | 482/52 |
| 2005/0181911 | A1 * | 8/2005 | Porth | 482/52 |
| 2005/0181912 | A1 * | 8/2005 | Eschenbach | 482/52 |
| 2005/0245361 | A1 * | 11/2005 | Wu et al. | 482/57 |
| 2006/0003868 | A1 * | 1/2006 | Lull et al. | 482/52 |
| 2006/0172865 | A1 * | 8/2006 | Dey et al. | 482/52 |
| 2006/0199702 | A1 * | 9/2006 | Eschenbach | 482/52 |
| 2006/0223678 | A1 * | 10/2006 | MacLean | 482/51 |
| 2007/0015632 | A1 * | 1/2007 | Eschenbach | 482/52 |
| 2007/0087906 | A1 * | 4/2007 | Rodgers, Jr. | 482/52 |
| 2007/0117684 | A1 * | 5/2007 | Liao et al. | 482/52 |
| 2007/0117685 | A1 * | 5/2007 | Liao et al. | 482/52 |
| 2007/0117686 | A1 * | 5/2007 | Liao et al. | 482/52 |
| 2007/0219061 | A1 * | 9/2007 | Rodgers, Jr. | 482/52 |
| 2007/0232457 | A1 * | 10/2007 | Porth | 482/51 |
| 2008/0032867 | A1 * | 2/2008 | Liao et al. | 482/52 |
| 2008/0051260 | A1 * | 2/2008 | Simonson et al. | 482/52 |
| 2008/0280731 | A1 * | 11/2008 | Dalebout et al. | 482/52 |
| 2008/0287264 | A1 * | 11/2008 | Chen | 482/52 |
| 2008/0287265 | A1 * | 11/2008 | Giannelli et al. | 482/52 |
| 2009/0048077 | A1 * | 2/2009 | Chuang et al. | 482/62 |

* cited by examiner

ELLIPTICAL EXERCISE DEVICE

BACKGROUND OF THE INVENTION

1. Field of the Invention

The present invention relates to an elliptical exercise device, and more particularly to an elliptical exercise device including an arrangement for allowing the exercise device to be adjusted to different moving strokes and for allowing the exercise device to be actuated or worked either as a stepping exerciser or an elliptical exerciser.

2. Description of the Prior Art

Typical exercise devices, such as stepping exercisers comprise a pair of handles pivotally attached to an upwardly extending frame member of a base support device, and a pair of foot supports pivotally coupled to the handles and arranged for allowing the foot supports to be stepped or moved up and down relative to the base support device.

For example, U.S. Pat. No. 5,290,211 to Stearns discloses one of the typical exercise devices also comprising a pair of handles pivotally attached to an upwardly extending frame member of a base support device, and a pair of foot supports pivotally coupled to the handles, and a pair of force resisting device pivotally coupling the foot supports to the upwardly extending frame member for allowing the foot supports to be stepped or moved up and down relative to the base support device.

However, normally, the middle portion of the foot supports is pivotally coupled to the upwardly extending frame member such that the middle portion of the foot supports is pivoted relative to the base support device but may not be moved cyclically or in reciprocating relative to the base support device, and such that the moving stroke of the typical exercise devices may not be suitably increased.

U.S. Pat. No. 5,499,956 to Habing et al. discloses a typical articulated lower body exercise device comprising a pair of foot supports pivotally coupled to the upwardly extending frame member of a base support device with a pair of vertical linkage arms, and a device for swinging the vertical linkage arms and the foot supports relative to the upwardly extending frame member of the base support device for allowing the foot supports to be stepped or moved elliptically relative to the base support device.

However, the middle portion of the foot supports is only pivoted relative to the base support device but may not be moved cyclically or in reciprocating relative to the base support device, and such that the moving stroke of the typical exercise devices may not be suitably increased.

U.S. Pat. No. 5,577,985 to Miller discloses a typical elliptical exercise device comprising a pair of guide links or handles pivotally attached to an upright support, and a pair of foot supports each pivotally coupled to the handles, and a pair of cranks pivotally coupled to the handles and the foot supports with an intermediate link and a control link, for swinging the handles and the foot supports relative to the base support device and for allowing the foot supports to be stepped or moved elliptically relative to the base support device.

However, the middle portion of the foot supports is only pivotally coupled to the handles, and may not be moved cyclically or in reciprocating relative to the base support device such that the moving stroke of the typical exercise devices may not be suitably increased or adjusted.

U.S. Pat. No. 5,595,553 to Rodgers, Jr. discloses another typical elliptical exercise device also comprising a pair of handles pivotally attached to an upright support, and a pair of foot supports each pivotally coupled to the handles, and a pair of cranks pivotally coupled to the foot supports with a reciprocating member for swinging the handles and the foot supports relative to the base support device and for allowing the foot supports to be stepped or moved elliptically relative to the base support device.

However, similarly, the foot supports is only pivotally coupled to the handles, and may not be moved cyclically or in reciprocating relative to the base support device such that the moving stroke of the typical exercise devices may not be suitably increased or adjusted.

U.S. Pat. No. 5,769,760 to Lin et al. discloses a further typical stationary exercise device comprising a pair of foot supports including a front portion pivotally coupled to an upright support, and a pair of handles also pivotally attached to the upright support, and a pair of cranks pivotally coupled to the handles for swinging the handles and the foot supports relative to the base support device and for allowing the foot supports to be stepped or moved elliptically relative to the base support device.

However, the handles are located closer to the users, and are pivotally coupled to the upright support and may also be moved cyclically relative to the upright support of the base support device such that the handles will also be moved cyclically relative to the upright support and such that the handles may not be suitably or easily grasped and handled by the users.

U.S. Pat. No. 6,022,296 to Yu discloses a further typical stepping exercise device comprising a pair of handles pivotally coupled to an upright support with a pair of cranks, and a pair of foot supports including a middle portion pivotally attached to the base support and including a front portion pivotally coupled to the handles.

However, the foot supports are only coupled to the upright support or the base support such that the foot supports may only be stepped or moved up and down relative to the base support device, but may not be stepped or moved elliptically relative to the upright support of the base support device. The typical stepping exercise devices may not be stepped and actuated or worked either as a stepping exerciser or an elliptical exerciser.

The present invention has arisen to mitigate and/or obviate the afore-described disadvantages of the conventional elliptical exercise devices.

SUMMARY OF THE INVENTION

The primary objective of the present invention is to provide an exercise device including an arrangement for allowing the exercise device to be adjusted to different moving strokes.

The other objective of the present invention is to provide an exercise device including an arrangement for allowing the exercise device to be actuated or worked either as a stepping exerciser or an elliptical exerciser or to be convertible between a stepping exerciser and an elliptical exerciser.

In accordance with one aspect of the invention, there is provided an exercise device comprising a base including an upright support extended upwardly from the base, and including a rear portion, a spindle disposed on the upright support, two cranks rotatably coupled to the upright support with a shaft, the cranks each including a pivot rod attached to the crank and spaced away from the shaft, two handles including a middle portion attached to the spindle for allowing the handles to be pivotally coupled to the upright support with the spindle and for allowing the handles to be pivoted and swung relative to the upright support of the base, the handles each including a hand grip provided on an upper portion for being grasped or held by a user and each including a lower portion, two foot supports each including a front portion pivotally coupled to the cranks with a link for allowing the front portions of the foot supports to be moved cyclically relative to the upright support of the base by the cranks, and each including a rear portion pivotally coupled to the rear portion of the base, the lower portions of the handles being pivotally coupled to the foot supports to allow the foot supports to be controlled by the handles to change a moving stroke of the foot supports, and two levers coupled between the pivot rods of the cranks and the middle portions of the handles respectively for coupling the handles to the pivot rods of the cranks respectively.

The cranks each include an arm secured to the pivot rod and rotated in concert with respective crank relative to the shaft, the links are coupled to the arms respectively. The levers each include a first end pivotally coupled to the pivot rod of the crank, and each include a second end adjustably coupled to the middle portion of the handle respectively with a pivot pin.

The handles each include a first orifice formed in the middle portion of the handle for engaging with the pivot pin. The handles each include at least one second orifice formed in the middle portion of the handle for selectively engaging with the pivot pin and for adjusting the moving stroke of the foot supports.

A foot pedal is further provided and pivotally supported on each of the foot supports with a pivot rod for supporting the user. The lower portions of the handles are each pivotally coupled to the foot pedals of the foot supports with a lever. The lever is pivotally coupled to the foot pedal with a pivot pole.

A resisting device may further provided for resisting a rotational movement of the shaft and the cranks. The resisting device includes a wheel rotatably attached to the upright support with the shaft. The resisting device includes a rotary member rotatably attached to the upright support with an axle and coupled to the wheel.

The rear portions of the foot supports are pivotally coupled to on the rear portion of the base with a connecting member and to be swung relative to the rear portion of the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
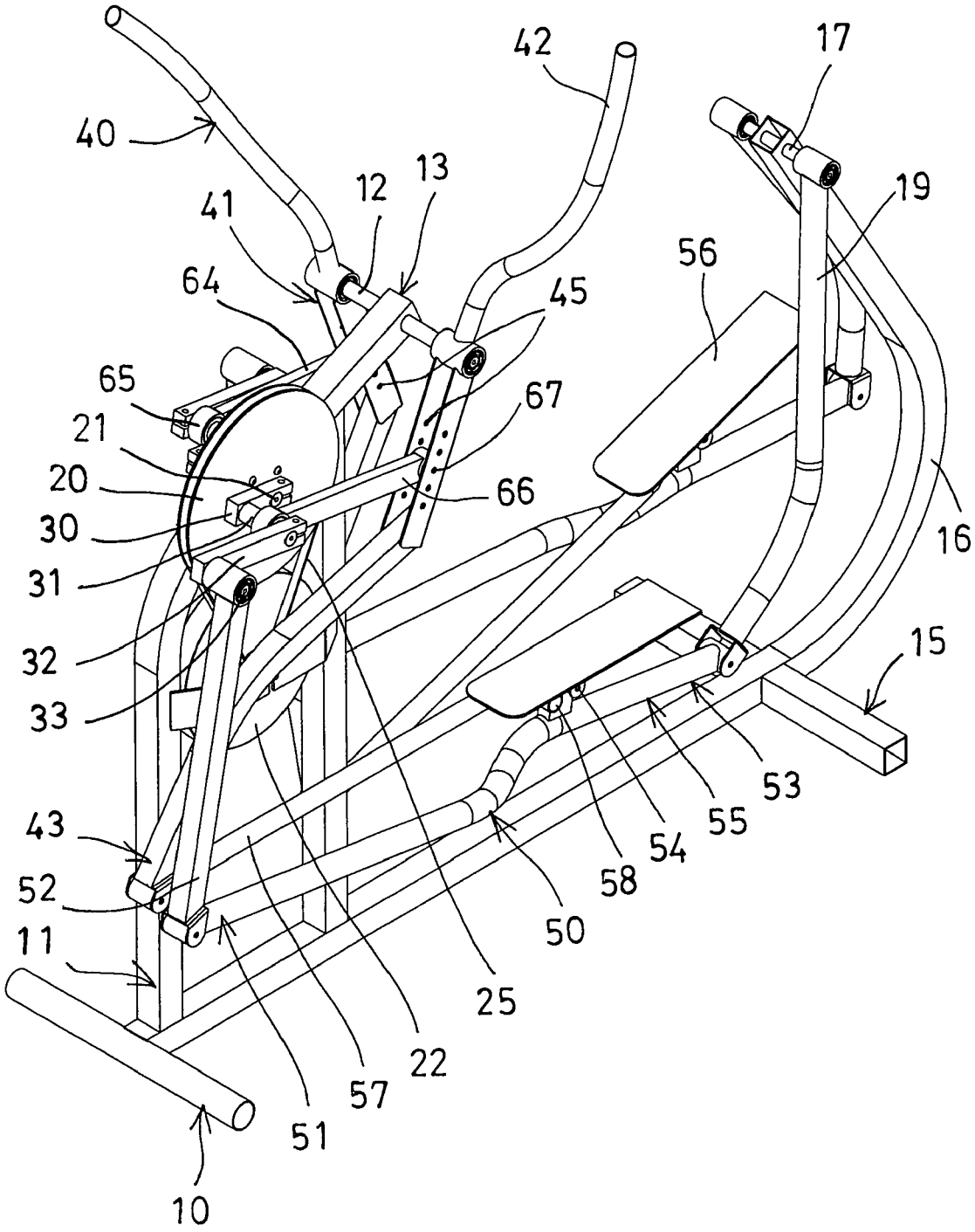
FIG. 1 is a front perspective view of an exercise device in accordance with the present invention.
Figure 2:
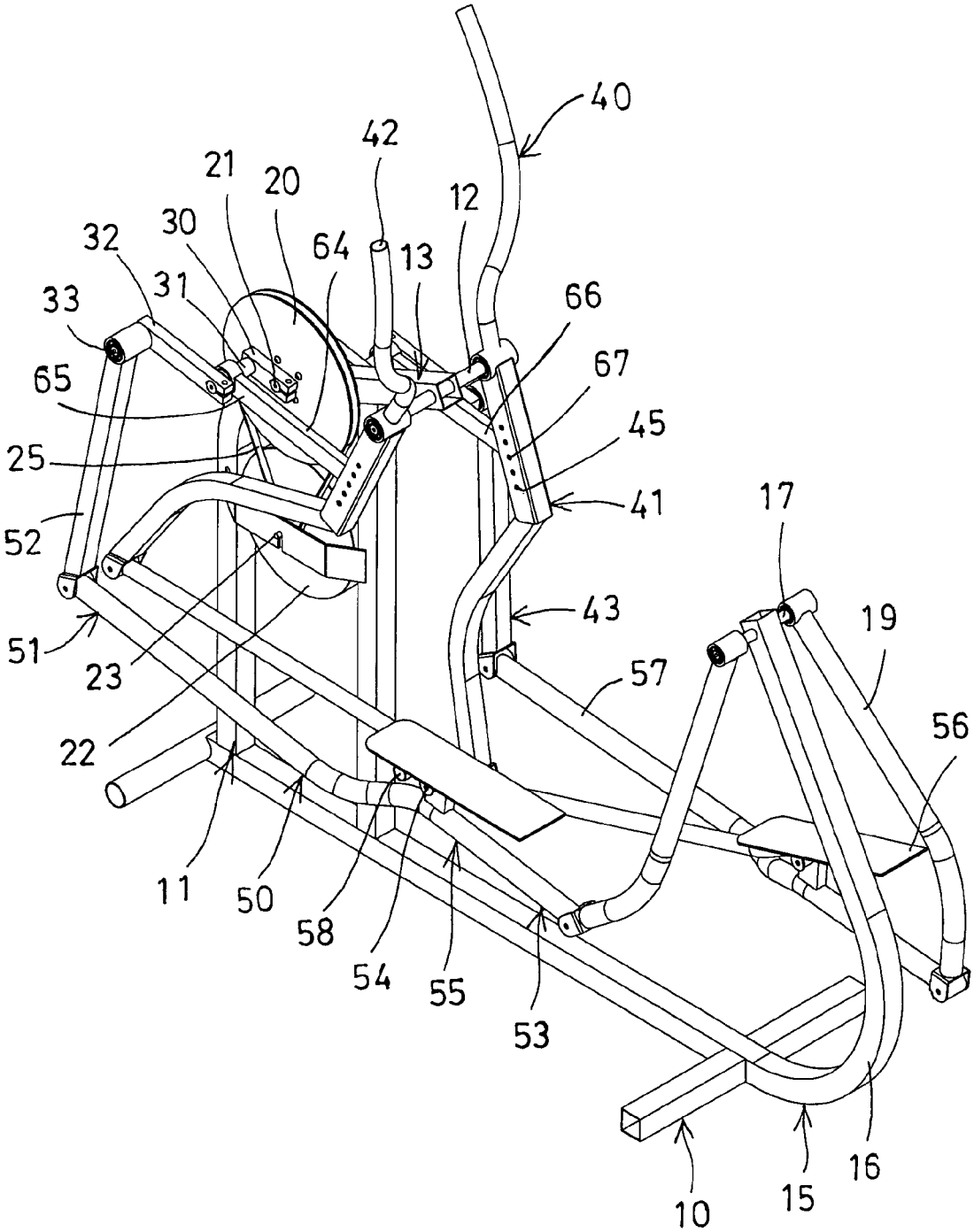
FIG. 2 is a rear perspective view of the exercise device.
Figure 3:
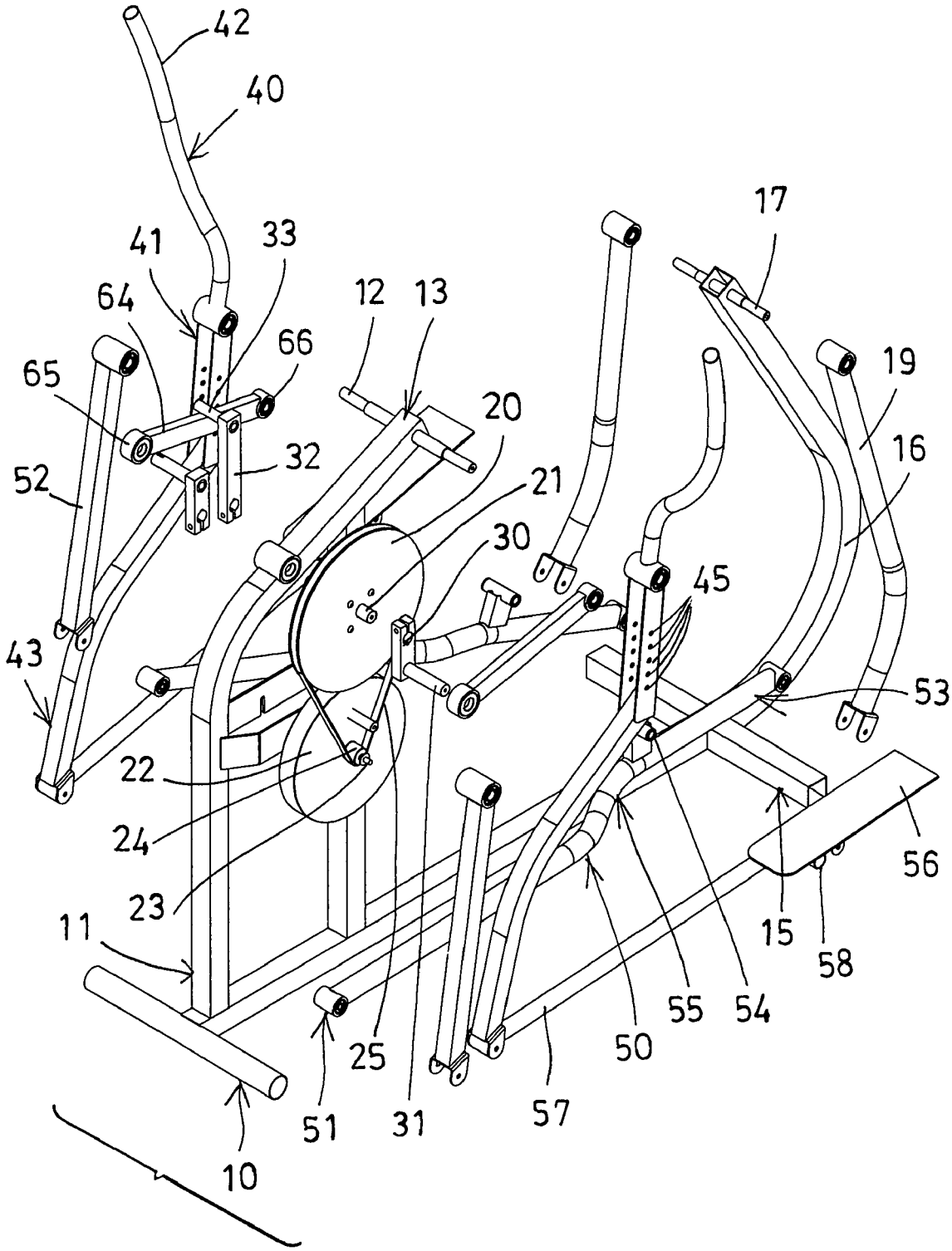
FIG. 3 is a partial exploded view of the exercise device as seen from the front portion of the exercise device.
Figure 4:
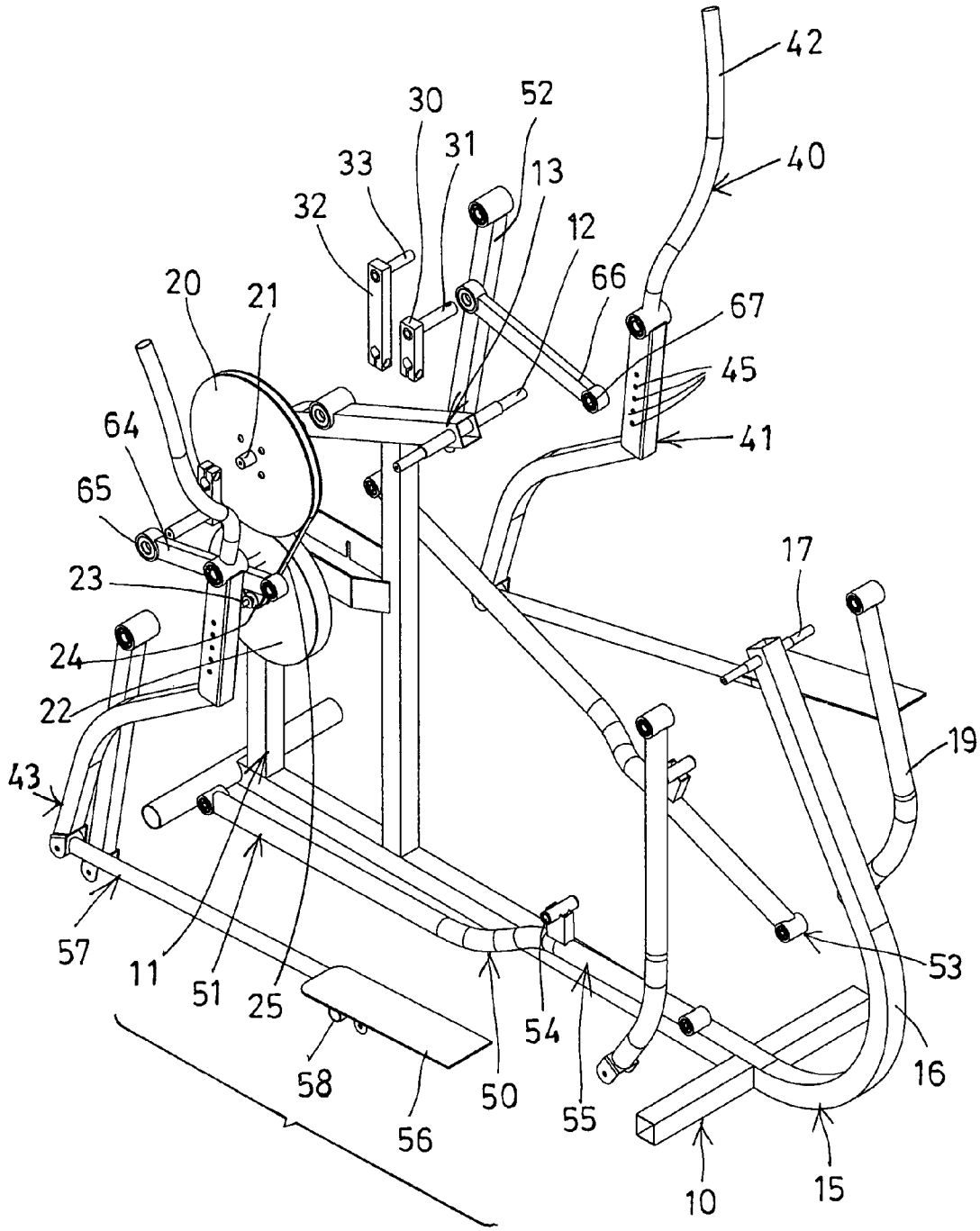
FIG. 4 is a partial exploded view of the exercise device as seen from the rear portion of the exercise device.
Figure 5:
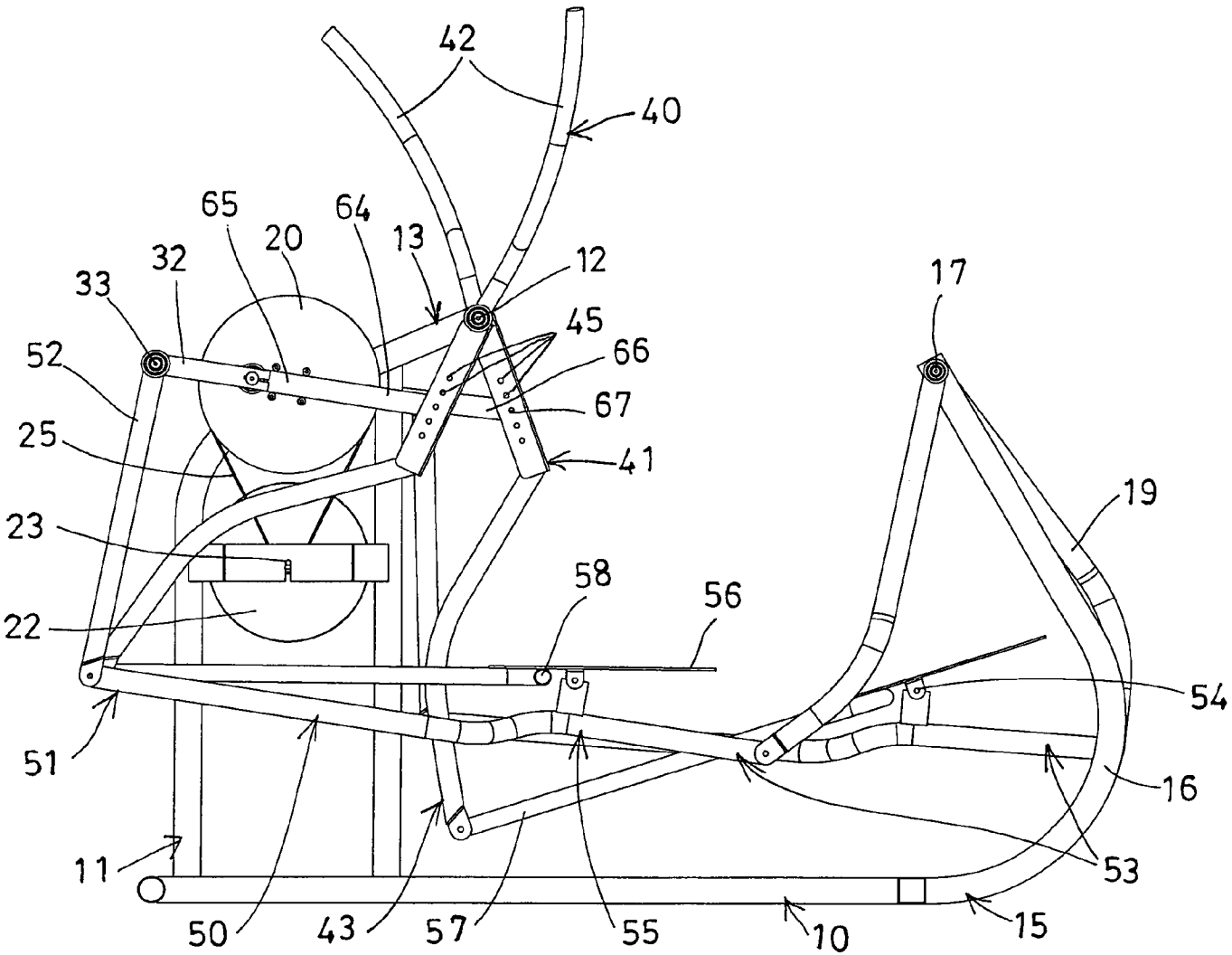
FIG. 5 is a side plan schematic view of the exercise device.

Referring to the drawings, and initially to FIGS. 1-5, an exercise device 1 in accordance with the present invention comprises a base 10, an upright support 11 extended upwardly from the base 10 for supporting a spindle 12 thereon, the spindle 12 is disposed or provided on such as the rear portion 13 of the upright support 11, a rotary member or pulley or wheel 20 is rotatably attached to the front or middle portion of the upright support 11 with a shaft 21, another wheel or pulley or rotary member 22 rotatably attached to the middle portion of the upright support 11 with an axle 23, a further wheel or rotary member or pulley or follower 24 attached or secured to the axle 23 (FIGS. 3, 4) and moved in concert with the axle 23, and the follower 24 is coupled to the wheel 20 with a coupling device 25.

For example, the coupling device 25 may be selected from such as a sprocket-and-chain coupling device or a gearing coupling device (not shown), or a belt 25 for allowing the follower 24 and the rotary member 22 to be rotated or driven by the wheel 20. The follower 24, the rotary member 22, the wheel 20 and the shaft 21 are coupled together to form a resistive means or device for resisting the rotational movement of the wheel 20 and the shaft 21, however, the other resistive device, such as the hydraulic or pneumatic resistive devices (not shown), or the magnetic retarding devices (not shown) may also be used to apply the resistive force against the wheel 20 and the shaft 21.

A pair of or two cranks 30 are secured to the shaft 21 such that the cranks 30 may be rotatably coupled to the middle portion of the upright support 11 with the shaft 21, the cranks 30 each include a pivot rod 31 provided or attached thereto or extended outwardly therefrom and spaced away from or distal to the shaft 21, a pair of or two handles 40 include an upper or middle portion 41 attached or secured to the spindle 12 for allowing the handles 40 to be pivotally coupled to the rear portion 13 of the upright support 11 with the spindle 12 and for allowing the handles 40 to be pivoted or swung relative to the upright support 11 of the base 10. The handles 40 each include a hand grip 42 formed or provided on the upper portion thereof for being grasped or held or operated by the users.

Two arms 32 are attached or secured to the pivot rods 31 and rotated in concert with the cranks 30 respectively around or relative to the shaft 21, or the arms 32 and the pivot rods 31 and the cranks 30 are secured together and rotatable around or relative to the shaft 21 in reciprocating action or the like, and the arms 32 may be taken as one portion of the respective cranks 30 or may be taken as one extension or extended portion of the respective cranks 30. Two arms 32 each include a pivot pin 33 provided or attached thereto or extended outwardly therefrom and spaced away from or distal to the pivot rods 31 and the shaft 21.

A pair of or two foot supports 50 each include a front portion 51 pivotally coupled to the pivot pin 33 of the arms 32 or the cranks 30 with a link 52 for allowing the front portions 51 of the foot supports 50 to be moved cyclically relative to the upright support 11 of the base 10 by the arms 32 and the cranks 30, and each include a rear portion 53 pivotally coupled to or supported on the rear portion 15 of the base 10. For example, the base 10 includes an upright post 16 extended upwardly from the rear portion 15 of the base 10 for supporting an axle 17 thereon, and the rear portions 53 of the foot supports 50 are pivotally coupled to or supported on the rear portion 15 of the base 10 with the post 16 and the axle 17 and a connecting member 19 for allowing the rear portions 53 of the foot supports 50 to be swung relative to the upright post 16 of the base 10.

The foot supports 50 each include a pivot rod 54 disposed or provided on the middle portion 55 thereof for pivotally coupling or supporting a foot pedal 56 thereon and for supporting the feet of the users and for allowing the foot pedal 56 to be rotated or pivoted relative to the foot supports 50. The lower portions 43 of the handles 40 are pivotally coupled to the foot supports 50 respectively for allowing the foot supports 50 and the handles 40 to be pivotally coupled together.

For example, the lower portions 43 of the handles 40 are pivotally coupled to the foot supports 50 or the foot pedals 56 with a lever arm 57 respectively, and the lever arm 57 may be pivotally coupled to the pivot rod 54 or pivotally coupled to the foot pedal 56 with a pivot pole 58 (FIG. 5) for allowing the foot pedal 56 to be rotated or pivoted relative to the foot supports 50 to different angular positions by the handles 40.

Figure 8:
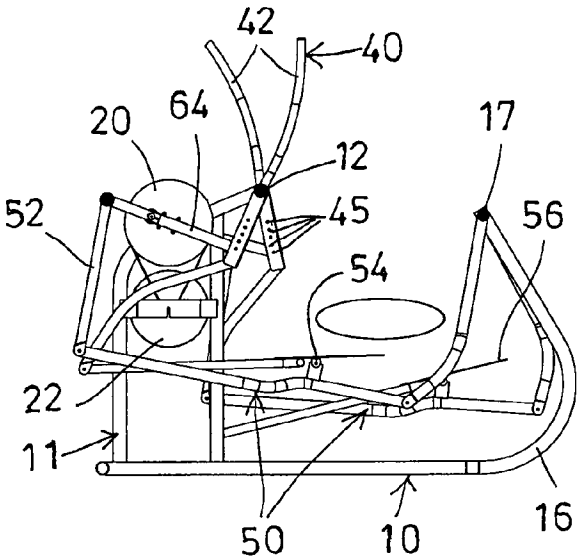
FIGS. 6, 7, 8 are side plan schematic views similar to FIG. 5, illustrating the operation of the exercise device.
Figure 7:
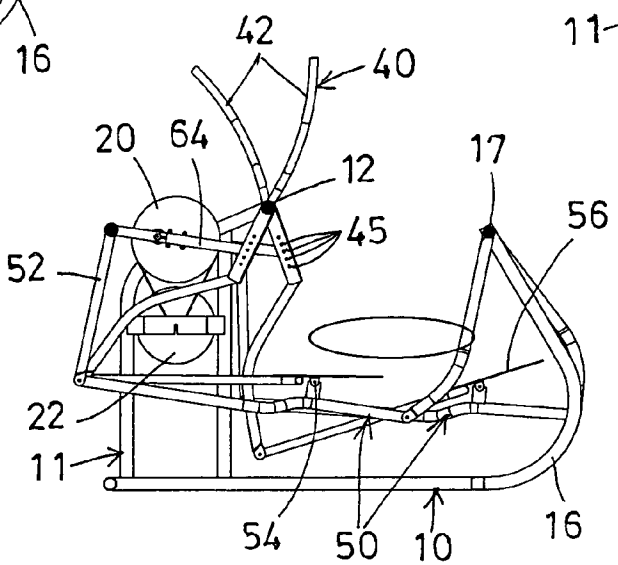
Figure 6:
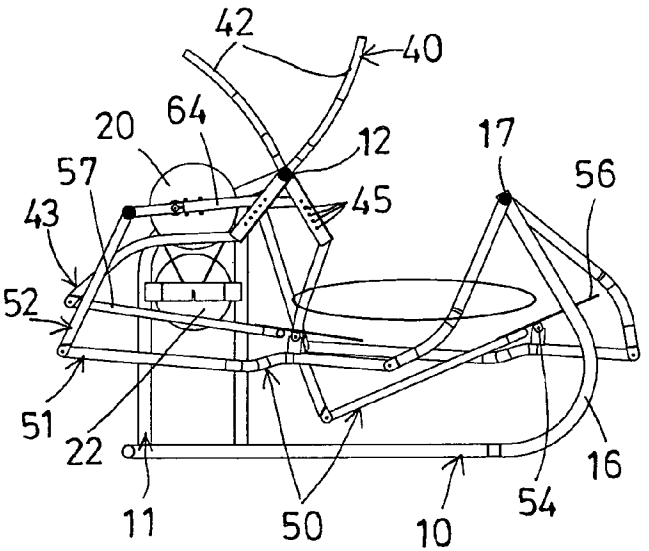

In operation, the handles 40 may be pivoted or swung relative to the upright support 11 of the base 10 with the spindle 12 of the upright support 11, and the rear portions 53 of the foot supports 50 may be pivoted or swung relative to the upright post 16 of the base 10 with the axle 17, and the front portions 51 of the foot supports 50 may be moved cyclically relative to the upright support 11 of the base 10 by the arms 32 and the cranks 30, such that the foot pedals 56 of the foot supports 50 may be moved elliptically relative to the base 10 (FIGS. 6-8). It is to be noted that the swinging movement or the moving stroke of the handles 40 may be controlled by the users in order to control and to determine the moving stroke of the foot supports 50 selectively.

It is preferable, but not necessary that a pair of or two levers 64 may further be provided and coupled between the pivot rods 31 of the cranks 30 and the middle portions 41 of the handles 40 respectively for coupling the handles 40 to the pivot rods 31 of the cranks 30 respectively and/or for coupling the handles 40 together. For example, the levers 64 each include one end or first end or front portion 65 pivotally coupled to the pivot rod 31 of the cranks 30, and each include the other end or second end or rear portion 66 pivotally coupled to the middle portions 41 of the handles 40 with a fastener or securing device or pivot pin 67 which is spaced away from the spindle 12, for allowing the handles 40 to be coupled together.

It is preferable that the handles 40 each include one or more orifices 45 formed or provided in the middle portion 41 thereof for selectively engaging with the pivot pin 67 and for allowing the pivot pin 67 to be moved or adjusted relative to the middle portions 41 of the handles 40 and thus for allowing the coupling between the handles 40 and the foot pedal 56 or the foot supports 50 to be selectively moved or adjusted and thus for allowing the moving stroke of the foot pedal 56 or the foot supports 50 to be selectively adjusted. In operation, the middle portions 41 of the handles 40 may be pivoted or swung relative to the upright support 11 of the base 10 with the spindle 12, and the levers 64 may be moved cyclically in reciprocating action, and the foot pedal 56 or the foot supports 50 may be elliptically by the users (FIGS. 6-8). The moving stroke of the foot pedal 56 or the foot supports 50 may be adjusted by engaging the pivot pin 67 with different orifices 45 of the handles 40.

The provision and the coupling of the wheel 20, and the rotary member 22, and the follower 24 may be formed or acted as a resisting means or device for applying a resistive force or a retarding force against the wheel 20 and the shaft 21 and thus the cranks 30 and the link 52 and the foot supports 50 and the handles 40, and thus for resisting the rotational movement of the wheel 20 and the shaft 21 and the cranks 30 and also for resisting the swinging movement of the link 52 and the handles 40. A magnetic retarding device (not shown) may further be provided and coupled to the wheel 20 and/or the rotary member 22 and/or the follower 24 for further applying a resistive force against the wheel 20 and/or the rotary member 22 and/or the follower 24 and for further resisting the swinging movement of the link 52 and the handles 40.

It is to be noted that the handles 40 each include the lower portion 43 pivotally coupled to the foot pedals 56 and/or the foot supports 50 with the lever arms 57 for allowing the movement of the foot supports 50 and/or the moving stroke of the foot supports 50 to be controlled by the users with the handles 40 and for allowing the users to freely and selectively adjust the moving stroke of the foot supports 50, and the moving strokes of the foot supports 50 may thus be determined or changed or controlled with the handles 40 when the levers 64 are removed or disengaged from the handles 40 and the pivot rod 31 of the cranks 30.

Accordingly, the exercise device in accordance with the present invention includes an arrangement for allowing the exercise device to be adjusted to different moving strokes, and for allowing the exercise device to be actuated or worked either as a stepping exerciser or an elliptical exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An exercise device comprising:

a base including an upright support extended upwardly from said base, and including a rear portion, a spindle disposed on said upright support, two cranks rotatably coupled to said upright support with a shaft and disposed in front of said spindle, said cranks each including a pivot rod attached to said crank and spaced away from said shaft, two handles including a middle portion attached to said spindle for allowing said handles to be pivotally coupled to said upright support with said spindle and for allowing said handles to be pivoted and swung relative to said upright support of said base, said handles each including a hand grip provided on an upper portion for being grasped or held by a user and each including a lower portion, two foot supports each including a front portion pivotally coupled to said cranks with a link for allowing said front portions of said foot supports to be moved cyclically relative to said upright support of said base by said cranks, and each including a rear portion pivotally coupled to said rear portion of said base, a foot pedal pivotally supported on each of said foot supports with a pivot rod for supporting the user, said lower portions of said handles each being pivotally coupled to said foot pedals of said foot supports with a lever arm, said lower portions of said handles being pivotally coupled to said foot supports to allow said foot supports to be controlled by said handles to change a moving stroke of said foot supports, and two levers coupled between said pivot rods of said cranks and said middle portions of said handles respectively for coupling said handles to said pivot rods of said cranks respectively, said link is pivotally attached at a distal end of said foot support.

2. The exercise device as claimed in claim 1, wherein said cranks each include an arm secured to said pivot rod and rotated in concert with respective crank relative to said shaft, said links are coupled to said arms respectively.

3. The exercise device as claimed in claim 1, wherein said levers each include a first end pivotally coupled to said pivot rod of said crank, and each include a second end adjustably coupled to said middle portion of said handle respectively with a pivot pin.

4. The exercise device as claimed in claim 3, wherein said handles each include a first orifice formed in said middle portion of said handle for engaging with said pivot pin.

5. The exercise device as claimed in claim 4, wherein said handles each include at least one second orifice formed in said middle portion of said handle for selectively engaging with said pivot pin.

6. The exercise device as claimed in claim 1, wherein said lever arm is pivotally coupled to said foot pedal with a pivot pole.

7. The exercise device as claimed in claim 1 further comprising a wheel rotatable attached to said upright support with said shaft, and a rotary member rotatable attached to said upright support with an axle and coupled to said wheel for resisting a rotational movement of said shaft and said cranks.

8. The exercise device as claimed in claim 1, wherein said rear portions of said foot supports are pivotally coupled to said rear portion of said base with a connecting member and to be swung relative to said rear portion of said base.

* * * * *